US011180703B2

(12) United States Patent
Luebke et al.

(10) Patent No.: US 11,180,703 B2
(45) Date of Patent: Nov. 23, 2021

(54) INTEGRATED STABILIZER FOR TWO STAGE C7 ISOMERIZATION

(71) Applicant: UOP LLC, Des Plaines, IL (US)

(72) Inventors: Charles P. Luebke, Mount Prospect, IL (US); Lin Jin, Inverness, IL (US); Cora Wang Ploentham, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/773,275

(22) Filed: Jan. 27, 2020

(65) Prior Publication Data

US 2021/0230489 A1 Jul. 29, 2021

(51) Int. Cl.
*C10G 63/02* (2006.01)
*C10G 35/04* (2006.01)

(52) U.S. Cl.
CPC ..... *C10G 63/02* (2013.01); *C10G 35/04* (2013.01); *C10G 2300/1096* (2013.01); *C10G 2300/305* (2013.01); *C10G 2300/4081* (2013.01); *C10G 2400/02* (2013.01)

(58) Field of Classification Search
CPC ..... C10G 63/02; C10G 35/04; C10G 2300/1096; C10G 2400/02; C10G 2300/305; C10G 2300/4081
See application file for complete search history.

(56) References Cited

U.S. PATENT DOCUMENTS

| | | | | |
|---|---|---|---|---|
| 2,479,110 | A | 8/1949 | Haensel | |
| 4,181,599 | A * | 1/1980 | Miller | B01J 29/44 208/111.35 |
| 4,929,333 | A | 5/1990 | Moser et al. | |
| 5,128,300 | A | 7/1992 | Chao et al. | |
| 9,573,109 | B2 | 2/2017 | Shecterle | |
| 10,294,430 | B1 | 5/2019 | Jin et al. | |
| 10,301,558 | B1 | 5/2019 | Luebke et al. | |
| 2006/0270885 | A1 * | 11/2006 | Boyer | C07C 5/2791 585/741 |

(Continued)

FOREIGN PATENT DOCUMENTS

WO 2016176069 A1 11/2016

OTHER PUBLICATIONS

Written Opinion from corresponding PCT application No. PCT/US2021/014276, completed Apr. 1, 2021.

(Continued)

*Primary Examiner* — Randy Boyer
*Assistant Examiner* — Juan C Valencia

(57) ABSTRACT

Improved processes for production of gasoline with 95 RONC including a $C_5$-$C_6$ isomerization zone, two $C_7$ isomerization zones, and a reforming zone are described. The first and second $C_7$ isomerization zones share a common stabilizer which strips off the chlorides and removes the light ends. The capital and operating costs of the processes are reduced through the elimination of one of the stabilizer columns and the associated condenser, receiver, trim cooler, and reboiler. The processes improve the RONC of the $C_7$ isomerization product because unconverted methylcyclohexane is recycled back to the second $C_7$ isomerization zone to be converted into dimethylcyclopentane.

20 Claims, 5 Drawing Sheets

(56) References Cited

U.S. PATENT DOCUMENTS

| | | | | |
|---|---|---|---|---|
| 2013/0225886 | A1* | 8/2013 | Gajda | C10G 35/02<br>585/302 |
| 2015/0166438 | A1* | 6/2015 | Glover | C07C 7/04<br>585/303 |

OTHER PUBLICATIONS

International Search Report from corresponding PCT application No. PCT/US2021/014276, dated Apr. 29, 2021.

* cited by examiner

INTEGRATED STABILIZER FOR TWO STAGE C7 ISOMERIZATION

BACKGROUND

Gasoline specifications are becoming stricter and more difficult for refiners to meet. For example, it is difficult for hydrocracker-based refineries to meet the aromatics specifications in the Euro-V gasoline standard while maximizing 95 RONC (research octane number clear) without having a heavy naphtha export stream. For example, certain standards may limit gasoline to concentrations of no more than 35 lv % aromatics; concentration of no more than 1.0 lv % benzene; distillation specifications and Reid vapor pressure (RVP) limit etc. The heavy naphtha export stream may have lower value, thus reducing the refiner's profitability.

A typical hydrocracker based refinery naphtha block includes a $C_5$-$C_6$ isomerization zone and a catalytic reforming zone. In order to minimize aromatics production, a portion of the $C_7$ needs to be removed from the feed to the catalytic reforming zone. This can be done with a second naphtha splitter or a side draw from a naphtha splitter, for example. Although this approach minimizes the amount of aromatics produced from $C_7$s, it does not allow for 95 RONC gasoline production due to the low blending octanes of components in the $C_7$ stream when blending directly to the gasoline pool.

A solution is to use a single stage $C_7$ isomerization zone with a large recycle stream to maximize the octane of the isomerate. In order to maximize the octane, a deisoheptanizer (DIHP) column is used to produce an overhead stream, a side cut stream, and a bottom stream. The overhead stream primarily comprises high octane multi-branched $C_7$ hydrocarbons. The side draw stream is a mixture of single-branched, normal, and cycloalkane $C_7$s. This is a lower octane stream and is recycled back to the reactor to be converted to multi-branched $C_7$s. The bottom stream comprises n-heptane, $C_7$ cycloalkanes and heavies. In order to achieve a high proportion of 95 RONC gasoline, the $C_7$ isomerization zone configuration results in very high operating costs due to the large recycle stream and a lack of on-stream flexibility due to the single isomerization stage.

Therefore, there is a need for a more flexible process of making gasoline with an increased amount of 95 RONC.

SUMMARY AND DETAILED DESCRIPTION

Figure 1:
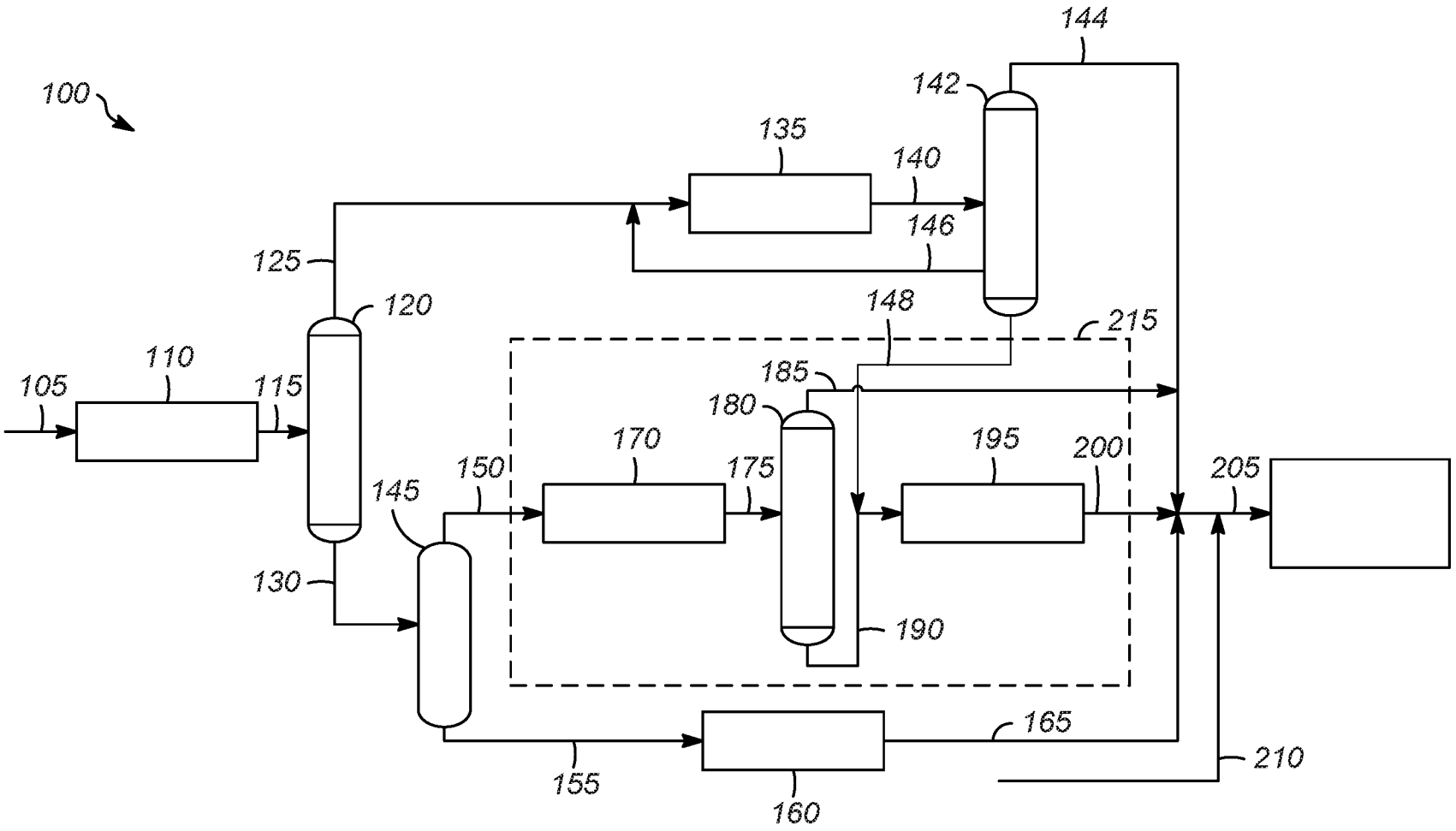
FIG. 1 is an illustration of an existing gasoline process incorporating two $C_7$ isomerization zones.

An integrated process for production of gasoline with 95 RONC was developed, as described in U.S. Pat. Nos. 10,294,430 and 10,301,558, each of which is incorporated herein in its entirety. The process includes a $C_5$-$C_6$ isomerization zone, two $C_7$ isomerization zones, and a reforming zone. The use of two $C_7$ isomerization zones eliminates the need for the large recycle stream from the deisoheptanizer.

This configuration results in significant savings in operating costs and increases the total gasoline yield from the complex.

The first $C_7$ isomerization zone is designed to isomerize $C_7$ paraffins. The product from the first $C_7$ isomerization zone is sent to a deisoheptanizer column in order to separate a $C_7$ isoparaffin-containing stream (typically 20-100 mol % iso-paraffins, or 30-100 mol %) as an overhead and a $C_7$ cycloalkane-containing stream (typically 20-100 mol % cycloalkane, or 30-100 mol %, or 40-100 mol %, or 50-100 mol %) as a bottom stream. The $C_7$ cycloalkane-containing stream is sent to the second $C_7$ isomerization zone. The second $C_7$ isomerization zone is designed to maximize the isomerization of $C_7$ cycloalkanes to higher octane cycloalkanes. Including a second $C_7$ isomerization zone enables better molecular management and improves the overall operation of the process.

The feed and operating conditions in the two $C_7$ isomerization zones are different in order to increase the octane and selectivity for the process. The first $C_7$ isomerization zone is optimized to increase the isomerization of $C_7$ paraffins and increase the $C_5^+$ retention. This is accomplished by running at lower temperature, which favors the formation of multi-branch $C_7$ paraffins, which have higher blending octanes. The choice of low temperature also reduces the cracking, and therefore increases the $C_5^+$ retention. Because the first $C_7$ isomerization zone has the maximum feed, operating at mild conditions has a significant impact on preserving total $C_5^+$ yield.

The presence of $C_7$ cycloalkane compounds in the feed to the first $C_7$ isomerization zone also inhibits paraffin cracking, increasing the $C_5^+$ yield. The lower temperatures in the first $C_7$ isomerization zone also favor the formation of methylcyclohexane, resulting in easier separation between multi-branched $C_7$ paraffins and $C_7$ cycloalkanes in the downstream deisoheptanizer. Methylcyclohexane has a boiling point of 100.4° C. (213.7° F.), which is much higher compared to the $C_7$ multi-branched paraffins and the $C_7$ cyclopentanes. Specifically, the dimethylcyclopentanes have boiling points between 87.8-91.7° C. (190.1-197° F.), and the multi-branched $C_7$ paraffins have boiling points between 79.2-89.8° C. (174.6° F. to 193.6° F.). The dimethylcyclopentanes include 1,1-dimethylcyclopentane, trans-1,3-dimethylcyclopentane and trans-1,2-dimethylcyclopentane.

The aromatics level in the first $C_7$ isomerization zone should be kept as low as possible to prevent significant exotherms due to aromatics saturation. For $C_7$ streams containing high levels of benzene or toluene (e.g., greater than about 2.5 wt %), it is desirable to saturate some or all of the aromatic compounds before isomerizing the $C_7$ stream in the first $C_7$ isomerization zone. A $C_7$ stream with a high benzene level would be sent first to a hydrogenation zone with a hydrogenation catalyst where the benzene is converted to cyclohexane with very low $C_5$+ yield losses. The resulting $C_7$ stream with cyclohexane would then be fed to the first $C_7$ isomerization zone. Some of the cyclohexane formed from benzene will be isomerized to higher octane methylcyclopentane in the first $C_7$ isomerization zone.

The feed to the second $C_7$ isomerization zone is primarily $C_7$ cycloalkanes, typically 20-100 mol % cycloalkanes, or 30-100 mol %, or 40-100 mol %, or 50-100 mol %. Cycloalkanes contain hydrogen and carbon atoms arranged in a structure containing a single ring with the ring having all single C—C bonds. There may be hydrocarbon side chains on the ring. Cyclopentanes are cycloalkanes (also known as naphthenes) that contain 5-member carbon rings and any number and type of side chains, for example, methylcyclopentane, 1,2-dimethylcyclopantene, ethylcyclopentane, etc. Cyclohexanes are cycloalkanes (also known as naphthenes) that contain 6-member carbon rings and any number and type of side chains, for example, cyclohexane, methylcyclohexane, ethylcyclohexane, etc.

The second $C_7$ isomerization zone is operated under conditions favoring the formation of cyclopentanes over cyclohexanes. The second $C_7$ isomerization zone is optimized to maximize the isomerization of $C_7$ cycloalkanes by operating at higher temperature. The cycloalkanes are more resistant to cracking than paraffins, so the higher operating temperatures in the second $C_7$ isomerization zone are possible without significant loss to light ends. Furthermore, at higher temperatures, equilibrium favors the formation of dimethylcyclopentanes which have a research octane numbers about 10 higher than methylcyclohexane.

The higher temperature of the second isomerization—zone helps meet the final blended gasoline specifications. This can be particularly important when meeting the Euro-V gasoline specification for RONC and E100 (vol % evaporated at 100° C.). For naphtha feed lean in $C_5$ and $C_6$, it is challenging to have enough light components to meet the E100 distillation specification (e.g., >46 vol %) for Euro-V gasoline. By converting methylcyclohexanes to dimethylcyclopentanes, the percent evaporated at 100° C. will be increased. These isomerization reactions increase the RONC of the stream and reduce the boiling points of the components in the product.

In some embodiments, an aromatic-containing stream can be added to the second $C_7$ isomerization zone, as described in U.S. Pat. Nos. 10,294,430 and 10,301,558. In this arrangement, the heat produced from aromatics saturation can reduce the energy needed to heat the feed of the second $C_7$ isomerization zone. In addition, the aromatic levels in the naphtha complex are reduced which help meet the gasoline pool specifications such as Euro-V specifications. Moreover, the aromatics convert to saturated cyclohexanes with a portion isomerizing to the higher octane cyclopentanes. For example, benzene would be saturated to form cyclohexane (83.0 RONC) and some would then isomerize to form methylcyclopentane (91.3 RONC). The aromatic-containing stream can be obtained from a reformate splitter or an additional fractionation on the naphtha splitter, for example, or from any other suitable sources.

The improved process enables much lower operating and capital costs, lower initial catalyst loading, and increased yields. For example, in some embodiments, the improved process configuration lowers the operating costs by about 57%, reduces the capital costs by about 11%, increases the octane barrels by about 4%, and increases operating flexibility compared with the existing process. The increased operating flexibility results from the fact that each $C_7$ isomerization zone can be independently controlled to maximize the different isomerization reactions and yield.

Although the processes described in U.S. Pat. Nos. 10,294,430 and 10,301,558 provide a number of benefits including lower capital and operating costs, there is a downside with the two-stage isomerization configuration as a result of the increase of equipment count due to having two reactor sections. As a result, further cost reduction was sought.

As a result, improved processes were developed in which the first and second $C_7$ isomerization zones share a common stabilizer which strips off the chloride compounds and removes the light ends (i.e., hydrogen and/or $C_{4-}$ hydrocarbons). The capital and operating costs of the processes are reduced through the elimination of one of the stabilizer columns and the associated condenser, receiver, trim cooler, overhead pumps, and reboiler.

Furthermore, the processes improve the RONC of the $C_7$ isomerization product because unconverted methylcyclohexane is recycled back to the second $C_7$ isomerization zone to be converted into dimethylcyclopentanes.

By recycling at least a portion of the second $C_7$ isomerization effluent back to the deisoheptanizer column(s) (whether the same column, separate columns, or columns with various types of internal walls dividing the column), it is possible to obtain $C_7$ cycloalkanes having different ratios of cyclopentanes, which results in streams having different octanes.

A small portion of the $C_{8+}$ compounds can be removed from the process using a drag stream. This can be accomplished by sending a sidecut from the deisoheptanizer to the second $C_7$ isomerization zone and taking a bottom drag stream from the deisoheptanizer. By varying this drag rate, the heavies ($C_{8+}$ compounds) content to the second $C_7$ isomerization zone can be controlled. Alternatively, a split can be taken from the bottoms of the deisoheptanizer. In some embodiments, the bottoms drag can be sent to the reformer for further octane upgrading. The octane of the bottoms drag stream can be increased from about 70 RONC to over 100 RONC in the reformer.

In some processes, it can be important to be able to control the molar ratio of hydrogen to hydrocarbon in the first and second $C_7$ isomerization zones separately. Better control of the ratio of hydrogen to hydrocarbon aids in improving the isomerization reactions, as well as catalyst stability. Previously, a hydrogen analyzer could be installed to measure hydrogen content in stabilizer off gas, total hydrocarbon feed, and a calculation block could be used to calculate $H_2$ to hydrocarbon ratio at reactor outlet so that the makeup hydrogen has coming to each $C_7$ isomerization zones could be adjust to meet a desired hydrogen to hydrocarbon ratio at the reactor outlet. However, when the effluent from both $C_7$ isomerization zones is sent to a common stabilizer, the off gas is combined together and it is hard to detect which unit is off the targeted hydrogen to hydrocarbon ratio. In order to address this problem, a stabilizer column with a wall extending downward from a top of the stabilizer column and ending above a bottom of the column was developed. The $C_7$ isomerization effluent from the first isomerization zone is introduced into a first side of the stabilizer column above the bottom of the wall, and the second $C_7$ isomerization effluent is introduced into the second side of the stabilizer column above the bottom of the wall. This arrangement keeps the off gas from each isomerization zone separated enabling measurement of the hydrogen content individually to control the hydrogen to hydrocarbon ratio. It will be important to be able to control the pressure on each side of the dividing wall in the stabilizer such that they are the same and the pressure difference between the two overhead sections can be controlled using a pressure differential indicator controller (PDIC) type of controller, for example.

In some embodiments of a naphtha complex, equipment can be shared with the $C_5$-$C_6$ isomerization zone to further reduce the total equipment count. For example, the chloride removal section, which is used to remove hydrogen chloride out of vapor outlet from of stabilizer receiver, and the drier regeneration equipment can be shared.

One aspect of the invention is a process for production of gasoline. In one embodiment, the process comprises: separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the light stream from the naphtha splitter in a $C_5$-$C_6$ isomerization zone at isomerization conditions to form a $C_5$-$C_6$ isomerization effluent; isomerizing the $C_7$ stream from the naphtha splitter in a first $C_7$ isomerization zone at first isomerization conditions favoring the formation of multi-branched $C_7$ paraffins to form a first $C_7$ isomerization effluent; introducing the first $C_7$ isomerization effluent into a single stabilizer column to remove chloride compounds and light ends to form a stabilized $C_7$ isomerization effluent; deisoheptanizing at least a portion of the first stabilized $C_7$ isomerization effluent in a deisoheptanizer into at least a first stream comprising multi-branched $C_7$ paraffins and $C_7$ cyclopentanes and a second stream comprising n-$C_7$ paraffins and $C_7$ cyclohexane hydrocarbons; isomerizing the second stream from the deisoheptanizer in a second $C_7$ isomerization zone at second isomerization conditions favoring the formation of cyclopentanes over cyclohexanes to form a second $C_7$ isomerization effluent; recycling at least a portion of the second $C_7$ isomerization effluent to the stabilizer column; reforming the heavy stream from the naphtha splitter in a reforming zone under reforming conditions forming a reformate effluent; blending one or more of: at least a portion of the $C_5$-$C_6$ isomerization effluent, the first stream from the deisoheptanizer, or the reformate effluent to form a gasoline blend.

In some embodiments, deisoheptanizing at least the portion of the first stabilized $C_7$ isomerization effluent comprises deisoheptanizing all of the first stabilized $C_7$ isomerization effluent.

In some embodiments, the process further comprises: introducing a gas stream from the overhead stream of the stabilizer column into a chloride removal section to remove the chloride compounds.

In some embodiments, the stabilizer column has a wall extending downward from a top of the stabilizer column and ending above a bottom of the stabilizer column, wherein the $C_7$ isomerization effluent is introduced into a first side of the stabilizer column above a bottom of the wall, wherein the second $C_7$ isomerization effluent is introduced into a second side of the stabilizer column above the bottom of the wall; and wherein deisoheptanizing at least the portion of the first stabilized $C_7$ isomerization effluent comprises deisoheptanizing all of the first stabilized $C_7$ isomerization effluent.

In some embodiments, the process further comprises: introducing a gas stream from the first side and a gas stream from the second side into a chloride removal section to remove the chloride compounds.

In some embodiments, the stabilizer column has a wall extending upward from a bottom of the stabilizer column and ending below a top of the column, wherein the $C_7$ isomerization effluent is introduced into a first side of the stabilizer column below a top of the wall, wherein at least the portion of the second $C_7$ isomerization effluent is introduced to a second side of the stabilizer column below the top of the wall; and wherein deisoheptanizing at least the portion of the first stabilized $C_7$ isomerization effluent comprises deisoheptanizing a bottom stream from the first side of the stabilizer column.

In some embodiments, the process further comprises: blending a bottom stream from the second side of the stabilizer column with the gasoline blend.

In some embodiments, the process further comprises: separating an overhead stream from the stabilizer column into a liquid stream and a gas stream; introducing the gas stream into a chloride removal section to remove the chloride compounds.

In some embodiments, deisoheptanizing at least the portion of the first stabilized $C_7$ isomerization effluent in the deisoheptanizer into at least the first stream and the second stream comprises deisoheptanizing at least the portion of the first stabilized $C_7$ isomerization effluent in the deisoheptanizer into at least the first stream, the second stream, and a third stream comprising $C_{8+}$ heavy hydrocarbons.

In some embodiments, the process further comprises at least one of: blending the third stream into the gasoline blend; or reforming the third stream.

In some embodiments, the process further comprises: blending a portion of the second $C_7$ isomerization effluent with the gasoline blend.

Another aspect of the invention is a process for production of gasoline. In one embodiment, the process comprises: separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the light stream from the naphtha splitter in a $C_5$-$C_6$ isomerization zone at isomerization conditions to form a $C_5$-$C_6$ isomerization effluent; isomerizing the $C_7$ stream from the naphtha splitter in a first $C_7$ isomerization zone at first isomerization conditions favoring the formation of multi-branched $C_7$ paraffins to form a first $C_7$ isomerization effluent; introducing the first $C_7$ isomerization effluent into a single stabilizer column to form an overhead stream and a first stabilized $C_7$ isomerization effluent; introducing a gas stream from the overhead stream of the stabilizer column into a chloride removal section to remove the chloride compounds; deisoheptanizing at least a portion of the first stabilized $C_7$ isomerization effluent in a deisoheptanizer into at least a first stream comprising multi-branched $C_7$ paraffins and $C_7$ cyclopentanes and a second stream comprising n-$C_7$ paraffins and $C_7$ cyclohexane hydrocarbons; isomerizing the second stream from the deisoheptanizer in a second $C_7$ isomerization zone at second isomerization conditions favoring the formation of cyclopentanes over cyclohexanes to form a second $C_7$ isomerization effluent; recycling at least a portion of the second $C_7$ isomerization effluent to the stabilizer column; reforming the heavy stream from the naphtha splitter in a reforming zone under reforming conditions forming a reformate effluent; blending one or more of: at least a portion of the $C_5$-$C_6$ isomerization effluent, the first stream from the deisoheptanizer, or the reformate effluent to form a gasoline blend.

In some embodiments, deisoheptanizing at least the portion of the first stabilized $C_7$ isomerization effluent comprises deisoheptanizing all of the first stabilized $C_7$ isomerization effluent.

In some embodiments, the stabilizer column has a wall extending downward from a top of the stabilizer column and ending above a bottom of the stabilizer column, wherein the $C_7$ isomerization effluent is introduced into a first side of the stabilizer column above a bottom of the wall, wherein the second $C_7$ isomerization effluent is introduced into a second side of the stabilizer column above the bottom of the wall; and wherein deisoheptanizing at least the portion of the first stabilized $C_7$ isomerization effluent comprises deisoheptanizing all of the first stabilized $C_7$ isomerization effluent.

In some embodiments, the process further comprises: introducing a gas stream from the first side and a gas stream from the second side into a chloride removal section to remove the chloride compounds.

In some embodiments, stabilizer column has a wall extending upward from a bottom of the stabilizer column and ending below a top of the column, wherein the $C_7$ isomerization effluent is introduced into a first side of the stabilizer column below a top of the wall, wherein at least the portion of the second $C_7$ isomerization effluent is introduced to a second side of the stabilizer column below the top of the wall; and wherein deisoheptanizing at least the portion of the first stabilized $C_7$ isomerization effluent comprises deisoheptanizing a bottom stream from the first side of the stabilizer column.

In some embodiments, the process of further comprises: blending a bottom stream from the second side of the stabilizer column with the gasoline blend.

In some embodiments, the process further comprises: separating an overhead stream from the stabilizer column into a liquid stream and a gas stream; introducing the gas stream into a chloride removal section to remove the chloride compounds.

In some embodiments, deisoheptanizing at least the portion of the first stabilized $C_7$ isomerization effluent in the deisoheptanizer into at least the first stream and the second stream comprises deisoheptanizing at least the portion of the first stabilized $C_7$ isomerization effluent in the deisoheptanizer into at least the first stream, the second stream, and a third stream comprising $C_{8+}$ heavy hydrocarbons.

In some embodiments, the process of further comprises at least one of: blending the third stream into the gasoline blend; or reforming the third stream.

FIG. 1 illustrates one embodiment of a process 100 incorporating two $C_7$ isomerization zones.

The naphtha feedstocks to the naphtha complex that can be used herein include hydrocarbons ranging from $C_4$ to $C_{12}$ consisting of normal paraffins, iso-paraffins, cycloalkanes and aromatics. The naphtha feedstock may also contain low concentrations of unsaturated hydrocarbons, sulfur-containing hydrocarbons, nitrogen-containing hydrocarbons, metals and other impurities.

The naphtha feed stream 105 is sent to a naphtha hydrotreater 110. Hydrotreating is a process in which hydrogen gas is contacted with a hydrocarbon stream in the presence of suitable catalysts which are primarily active for the removal of oxygenates and heteroatoms, such as sulfur, nitrogen, and metals from the hydrocarbon feedstock. In hydrotreating, hydrocarbons with double and triple bonds may be saturated. Aromatics may also be saturated. Typical hydrotreating reaction conditions include a temperature of about 290° C. (550° F.) to about 455° C. (850° F.), a pressure of about 3.4 MPa (500 psig) to about 6.2 MPa (900 psig), a liquid hourly space velocity of about 0.5 $hr^{-1}$ to about 4 $hr^{-1}$, and a hydrogen rate of about 168 to about 1,011 $Nm^3/m^3$ oil (1,000-6,000 scf/bbl). Typical hydrotreating catalysts include at least one Group 8 metal, preferably iron, cobalt and nickel, and at least one Group 6 metal, preferably molybdenum and tungsten, on a high surface area support material, preferably alumina. Other typical hydrotreating catalysts include zeolitic catalysts, as well as noble metal catalysts where the noble metal is selected from palladium and platinum.

The hydrotreated feed stream 115 is sent to a first naphtha splitter 120 where it is separated into a light overhead stream 125 and a bottom stream 130. The light overhead stream 125 comprises $C_6$ and lighter boiling hydrocarbons, and the bottom stream 130 comprises $C_{7+}$ hydrocarbons.

The light overhead stream 125 from the naphtha splitter 120 is sent to a $C_5$-$C_6$ isomerization zone 135. The $C_5$-$C_6$ isomerization zone 135 can be any type of isomerization zone that takes a stream of $C_5$-$C_6$ straight-chain hydrocarbons or a mixture of straight-chain, branched-chain, and cycloalkanes and converts straight-chain hydrocarbons in the feed mixture to branched-chain hydrocarbons and branched hydrocarbons to more highly branched hydrocarbons, thereby producing an effluent having branched-chain and straight-chain hydrocarbons. The $C_5$-$C_6$ isomerization zone 135 can include one or more isomerization reactors, feed-effluent heat exchangers, inter-reactor heat exchangers, driers, sulfur guards, separator, stabilizer, compressors, deisopentanizer column, deisohexanizer column, and other equipment as known in the art (not shown). A hydrogen-rich gas stream (not shown) is typically mixed with the light overhead stream 125 and heated to reaction temperatures. The hydrogen-rich gas stream, for example, comprises about 50-100 mol % hydrogen. The hydrogen can be separated from the reactor effluent, compressed and recycled back to mix with the light overhead stream 125.

The light overhead stream 125 and hydrogen are contacted in the $C_5$-$C_6$ isomerization zone 135 with an isomerization catalyst forming $C_5$-$C_6$ isomerization effluent 140. The catalyst composites that can be used in the $C_5$-$C_6$ isomerization zone 135 include traditional isomerization catalysts including chlorided platinum alumina, crystalline aluminosilicates or zeolites, and other solid strong acid catalysts such as tungstated zirconia, sulfated zirconia and modified sulfated zirconia. Suitable catalyst compositions of this type will exhibit selective and substantial isomerization activity under the operating conditions of the process.

Another suitable isomerization catalyst is a solid strong acid catalyst that comprises a sulfated support of an oxide or hydroxide of a Group IVB (IUPAC 4) metal, preferably zirconium oxide or hydroxide, at least a first component that is a lanthanide element or yttrium component, and at least a second component being a platinum-group metal component. The catalyst optionally contains an inorganic-oxide binder, especially alumina.

The support material of the solid strong acid catalyst comprises an oxide or hydroxide of a Group IVB (IUPAC 4). In one embodiment the Group IVB element is zirconium or titanium. Sulfate is composited on the support material. A component of a lanthanide-series element is incorporated into the composite by any suitable means. The lanthanide series element component may be selected from the group consisting of lanthanum, cerium, praseodymium, neodymium, promethium, samarium, europium, gadolinium, terbium, dysprosium, holmium, erbium, thulium, ytterbium and lutetium. Suitable amounts of the lanthanide series element component are in the range of about 0.01 to about 10 wt % on an elemental basis, of the catalyst. A platinum-group metal component is added to the catalytic composite by any means known in the art to effect the catalyst, e.g., by impregnation. The platinum-group metal component may be selected from the group consisting of platinum, palladium, ruthenium, rhodium, iridium, or osmium. Amounts in the range of from about 0.01 to about 2 wt % platinum-group metal component, on an elemental basis are suitable.

Optionally, the catalyst is bound with a refractory inorganic oxide. The binder, when employed, usually comprises from about 0.1 to 50 wt %, preferably from about 5 to 20 wt %, of the finished catalyst. The support, sulfate, metal components and optional binder may be composited in any order effective to prepare a catalyst useful for the isomerization of hydrocarbons. Examples of suitable atomic ratios of lanthanide or yttrium to platinum-group metal for this catalyst are at least about 1:1; for example about 2:1 or greater; such as about 5:1 or greater. The catalyst may optionally further include a third component of iron, cobalt, nickel, rhenium or mixtures thereof. For example, iron may be present in amounts ranging from about 0.1 to about 5 wt % on an elemental basis. In an exemplary embodiment, the solid strong acid isomerization catalyst is sulfated zirconia or a modified sulfated zirconia.

Another class of suitable isomerization catalysts for use herein includes the chlorided platinum alumina catalysts. The aluminum is preferably an anhydrous gamma-alumina with a high degree of purity. The catalyst may also contain other platinum group metals. The term "platinum group metals" refers to noble metals excluding silver and gold that are selected from the group consisting of platinum, palladium, germanium, ruthenium, rhodium, osmium, and iridium. These metals demonstrate differences in activity and selectivity such that platinum has now been found to be the most suitable for this process. The catalyst will contain from about 0.1 to about 0.25 wt % of the platinum. Other platinum group metals may be present in a concentration of from about 0.1 to about 0.25 wt %. The platinum component may exist within the final catalytic composite as an oxide or halide or as an elemental metal. The presence of the platinum component in its reduced state has been found most suitable for this process. The chloride component termed in the art "a combined chloride" is present in an amount from about 2 to about 10 wt % based upon the dry support material. The use of chloride in amounts greater than about 5 wt % has been found to be the most beneficial for this process. The inorganic oxide preferably comprises alumina and more preferably gamma-alumina, eta-alumina, and mixtures thereof.

It is generally known that high chlorided platinum-alumina catalysts of this type are highly sensitive to sulfur and oxygen-containing compounds. Therefore, the use of such catalysts requires that the feedstock be relatively free of such compounds. A sulfur concentration no greater than about 0.5 ppm is generally required for use of high chloride platinum-alumina catalysts. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below about 0.5 ppm so that the hydrocarbon will desorb the sulfur that has been adsorbed on the catalyst. Water can act to permanently deactivate the catalyst by removing high activity chloride from the catalyst and replacing it with inactive aluminum hydroxide. Therefore, water, as well as oxygenates, in particular $C_1$-$C_5$ oxygenates, that can decompose to form water, can only be tolerated in very low concentrations. In general, this requires a limitation of oxygenates in the feed to about 0.1 ppm or less. The feedstock may be treated by any method that will remove water and sulfur compounds. Sulfur may be removed from the feedstock stream by hydrotreating. A variety of commercial dryers are available to remove water from the feed components. Adsorption processes for the removal of sulfur and water from hydrocarbon streams are also well known to those skilled in the art.

Operating conditions within the $C_5$-$C_6$ isomerization zone 135 are selected to maximize the production of isoalkane product from the feed components. Temperatures within the isomerization zone will usually range from about 40° C. to about 235° C. (104° F. to 455° F.). Lower reaction temperatures usually favor equilibrium mixtures of isoalkanes versus normal alkanes. Lower temperatures are particularly useful in processing feeds composed of $C_5$ and $C_6$ alkanes where the lower temperatures favor equilibrium mixtures having the highest concentration of the most branched isoalkanes. When the feed mixture is primarily $C_5$ and $C_6$ alkanes, temperatures in the range of from about 60° C. to about 160° C. are suitable. The $C_5$-$C_6$ isomerization zone 135 may be maintained over a wide range of pressures. Pressure conditions in the isomerization of $C_4$-$C_6$ paraffins range from about 700 kPa(a) to about 7000 kPa(a). In other embodiments, pressures for this process are in the range of from about 2000 kPa(g) to 5000 kPa(g). The feed rate to the $C_5$-$C_6$ isomerization zone 135 can also vary over a wide range. These conditions include liquid hourly space velocities ranging from about 0.5 to about 12 $hr^{-1}$ however, with some embodiments having space velocities between about 1 and about 6 $hr^{-1}$.

The $C_5$-$C_6$ isomerization effluent 140 is sent to deisohexanizer 142 where it is separated into a deisohexanizer overhead stream 144 comprising multi-branched $C_6$ paraffins, a deisohexanizer lower sidecut stream 146 comprising n-$C_6$ paraffins and single-branched $C_6$ paraffins, and a deisohexanizer bottom stream 148 comprising $C_6$ cycloalkanes and heavies. The deisohexanizer lower sidecut stream 146 can be recycled to the $C_5$-$C_6$ isomerization zone 135. Alternatively, instead of the deisohexanizer overhead stream 144, there could be an upper sidecut comprising multi-branched $C_6$ paraffins, and an overhead stream (not shown) comprising $C_5$ paraffins. In this embodiment, the overhead stream could be recycled to a deisopentanizer column (not shown).

The bottom stream 130 from the first naphtha splitter 120 is sent to a second naphtha splitter 145 where it is separated into a $C_7$ overhead stream 150 comprising $C_7$ hydrocarbons and a $C_{8+}$ bottom stream 155 comprising $C_{8+}$ hydrocarbons. Alternatively, there could be a single naphtha splitter (conventional column or dividing wall column) separating the naphtha feed stream 115 into three streams: an overhead stream comprising $C_6$ and lighter boiling hydrocarbons, a sidecut stream comprising $C_7$ hydrocarbons, and a bottom stream comprising $C_{8+}$ hydrocarbons.

The $C_{8+}$ bottom stream 155 can be sent to reforming zone 160 to form reformate 165. In a common form, the reforming process can employ catalyst particles in several reaction zones interconnected in a series flow arrangement. Typically, a heavy naphtha stream and a hydrogen gas stream are preheated and charged to a reforming zone containing typically two to five reactors in series. Suitable heating means are provided between reactors to compensate for the net endothermic heat of reaction in each of the reactors. Reactants may contact the catalyst in individual reactors in either upflow, downflow, or radial flow fashion, with the radial flow mode being preferred. The catalyst may be contained in a fixed-bed system or, preferably, in a moving-bed system with associated continuous catalyst regeneration. Alternative approaches to reactivation of deactivated catalyst include semiregenerative operation, which includes shutting down the entire unit for catalyst regeneration and reactivation, or swing-reactor operation, which includes isolating a single reactor from the system, regenerating and reactivating while the other reactors remain on stream. Typically, continuous catalyst regeneration in conjunction with a moving-bed system is disclosed, inter alia, in, e.g., U.S. Pat. Nos. 3,647,680; 3,652,231; 3,692,496; and 4,832,921.

Generally, effluent from the reforming zone is passed through a cooling means to a separation zone, often maintained at about 0 to about 65° C., where a hydrogen gas stream is separated from a liquid stream commonly called "unstabilized reformate". The resultant hydrogen stream can then be recycled through suitable compressing means back to the reforming zone. Usually, the liquid phase from the separation zone is withdrawn and processed in a fractionating system in order to adjust the butane concentration, thereby controlling front-end volatility of the resulting reformate.

The reforming reactors can contain any suitable catalyst. The catalyst particles are typically comprised of one or more Group VIII (IUPAC 8-10) noble metals (e.g., platinum, iridium, rhodium, and palladium) and a halogen combined with a porous carrier, such as a refractory inorganic oxide. U.S. Pat. No. 2,479,110, for example, teaches an alumina-platinum-halogen reforming catalyst. Although the catalyst may contain about 0.05 to about 2.0 wt % of Group VIII metal, a less expensive catalyst, such as a catalyst containing about 0.05 to about 0.5 wt % of Group VIII metal may be used. In addition, the catalyst may contain indium and/or a lanthanide series metal such as cerium. The catalyst particles may also contain one or more Group IVA (IUPAC 14) metals (e.g., tin, germanium, and lead), such as described in U.S. Pat. Nos. 4,929,333, 5,128,300, and the references cited therein. The halogen is typically chlorine, and alumina is commonly the carrier. Suitable alumina materials include, but are not limited to, gamma, eta, and theta alumina. One property related to the performance of the catalyst is the surface area of the carrier. Preferably, the carrier has a surface area of about 100 to about 500 $m^2/g$. The activity of catalysts having a surface area of less than about 130 $m^2/g$ tend to be more detrimentally affected by catalyst coke than catalysts having a higher surface area. Generally, the particles are usually spheroidal and have a diameter of about 1.6 to about 3.1 mm (about 1/16 to about 1/8 inch), although they may be as large as about 6.35 mm (about 1/4 inch) or as small as about 1.06 mm (about 1/24 inch). In a particular reforming reaction zone, however, it is desirable to use catalyst particles which fall in a relatively narrow size range.

Typical feed inlet temperature for the reformers are between 440 and 580° C. (824 and 1076° F.), or between 500 and 580° C. (932 and 1076° F.), or between 540 and 580° C. (1004 and 1076° F.), or at least above 540° C. (932° F.). The reformer reactors may have different operating temperatures, for example, with a first reforming reactor having a temperature between 500 to 540° C. (932 to 1004° F.) and a second, subsequent reforming reactor having a temperature greater than 540° C. (1004° F.). The reformers can be operated at a range of pressures generally from atmospheric pressure of about 0 to about 6,895 kPa(g) (about 0 psig to about 1,000 psig), or about 276 to about 1,379 kPa(g) (about 40 to about 200 psig). The reaction conditions also include a liquid hour space velocity (LHSV) in the range from 0.6 $hr^{-1}$ to 10 $hr^{-1}$. Preferably, the LHSV is between 0.6 $hr^{-1}$ and 5 $hr^{-1}$, with a more preferred value between 1 $hr^{-1}$ and 5 $hr^{-1}$, and with a most preferred value between 2 $hr^{-1}$ and 5 $hr^{-1}$. The shorter residence time is especially preferred when utilizing the higher temperatures. The catalyst also has a residence time in the reformers of between 0.5 hours and 36 hours.

The $C_7$ stream 150 is sent to a first $C_7$ isomerization zone 170 to form a first $C_7$ isomerization effluent 175. The first $C_7$ isomerization zone 170 is operated under conditions favoring the formation of multi-branched $C_7$ paraffins and cyclohexanes.

The catalyst composites that can be used in the first $C_7$ isomerization zone 170 include traditional isomerization catalysts including chlorided platinum alumina, crystalline aluminosilicates or zeolites, and other solid strong acid catalysts such as tungstated zirconia, sulfated zirconia and modified sulfated zirconia. Suitable catalyst compositions of this type will exhibit selective and substantial isomerization activity under the operating conditions of the process.

Operating conditions within the first $C_7$ isomerization zone 170 are selected to favor the formation of multi-branched $C_7$ paraffins and cyclohexanes. Temperatures within the first $C_7$ isomerization zone 170 will usually range from about 40° C. to about 235° C. (104° F. to 455° F.), with reactor inlet temperatures ranging from about 80° C. to 180° C., or from about 90° C. to 170° C. The lower reaction temperatures will favor higher equilibrium mixtures of multi-branched $C_7$ paraffins, will reduce the hydrocracking of $C_7$ paraffins to undesired $C_4^-$ light ends, and favor the formation of cyclohexanes. In some embodiments, it is advantageous to keep the temperature rise in the $C_7$ isomerization zone 170 within these ranges to prevent excessive hydrocracking of $C_7$ paraffins which leads to light ends and loss of $C_5^+$ gasoline yields. The benzene and toluene levels should be kept as low as possible in $C_7$ stream 150 to prevent significant exotherms within the first $C_7$ isomerization zone 170. For high aromatic-containing feeds (e.g., greater than about 2.5 wt %, or greater than about 5.0 wt %), the $C_7$ stream 150 can be mixed with a hydrogen-rich gas stream (as described above) and optionally processed in an aromatic hydrogenation unit (not shown) that utilizes a suitable aromatic hydrogenation catalyst that results in aromatic saturation with little or no hydrocracking activity so as to prevent yield losses to $C_4^-$ light ends. By removing the aromatic saturation from the first $C_7$ isomerization zone 170, the large exotherm due to high aromatics is removed, thus allowing first $C_7$ isomerization zone 170 to operate at the desired lower temperatures. The effluent from the aromatic hydrogenation unit is then fed to the first $C_7$ isomerization zone 170.

The first $C_7$ isomerization zone 170 may be maintained over a wide range of pressures. Pressure conditions range from about 700 kPa(a) to about 7000 kPa(a). In other embodiments, pressures range from about 1000 kPa(a) to 3200 kPa(a). The feed rate to the first $C_7$ isomerization zone can also vary over a wide range. These conditions include liquid hourly space velocities ranging from about 0.5 to about 12 $hr^{-1}$, with some embodiments having liquid hourly space velocities between about 1 and about 10 $hr^{-1}$.

The first $C_7$ isomerization effluent 175 is sent to a deisoheptanizer 180 where it is separated into a deisoheptanizer overhead stream 185, and a deisoheptanizer bottom stream 190. The deisoheptanizer overhead stream 185 comprises multi-branched $C_7$ hydrocarbons and $C_7$ cycloalkanes with cyclopentane-rings, and the deisoheptanizer bottom stream 190 comprises n-$C_7$, $C_7$ cycloalkanes with cyclohexane-rings and heavies.

The deisoheptanizer bottom stream 190 is sent to the second $C_7$ isomerization zone 195. The second $C_7$ isomerization zone 195 is operated under conditions favoring the formation of cycloalkanes with cyclopentane-rings over cyclohexane-rings.

The catalyst composites that can be used in the second $C_7$ isomerization zone 195 include traditional isomerization catalysts including chlorided platinum alumina, crystalline aluminosilicates or zeolites, and other solid strong acid catalysts such as tungstated zirconia, sulfated zirconia and modified sulfated zirconia. Suitable catalyst compositions of this type will exhibit selective and substantial isomerization activity under the operating conditions of the process.

Operating conditions within the second $C_7$ isomerization zone 195 are selected to favor the formation of cycloalkanes with cyclopentane-rings over cyclohexane-rings. Temperatures within the second $C_7$ isomerization zone 195 will usually range from about 175° to about 325° C. (347° to 617° F.), with reactor outlet temperatures typically above about 200° C.

The second $C_7$ isomerization zone 195 may be maintained over a wide range of pressures. Pressure conditions range from about 700 kPa(a) to about 7000 kPa(a). In other embodiments, pressures range from about 1000 kPa(a) to 3200 kPa(a). The feed rate to the second $C_7$ isomerization zone 195 can also vary over a wide range. These conditions include liquid hourly space velocities ranging from about 0.5 to about 20 $hr^{-1}$, with some embodiments having liquid hourly space velocities between about 1 and about 15 $hr^{-1}$. The second $C_7$ isomerization zone 195 typically runs at equal or higher liquid hourly space velocities than the first $C_7$ isomerization zone 170.

The first and second $C_7$ isomerization zones 170, 195 can include one or more isomerization reactors, feed-effluent heat exchangers, inter-reactor heat exchangers, driers, sulfur guards, separator, stabilizer, compressors and other equipment as known in the art, as will be discussed further below.

The catalysts used in the first and second $C_7$ isomerization zones 170, 195 can be those described above with respect to the $C_5$-$C_6$ isomerization zone 135.

The deisohexanizer overhead stream 144, the deisoheptanizer overhead stream 185, the second $C_7$ isomerization effluent 200, and the reformate 165 are combined to form a gasoline stream 205. Optionally, one or more additional streams 210 could also be included in the gasoline stream 205. For example, the additional stream 210 could be a $C_4$ stream comprising n-$C_4$ and iso-$C_4$ paraffins.

One or more of the naphtha hydrotreater 110, the first and second naphtha splitters 120, 145, the $C_5$-$C_6$ isomerization zone 135, the reforming zone 160, the first $C_7$ isomerization zone 170, the deisoheptanizer 180, and the second $C_7$ isomerization zone 195 can be connected to a controller (not shown) which can be used to monitor and control the various processes.

Figure 2:
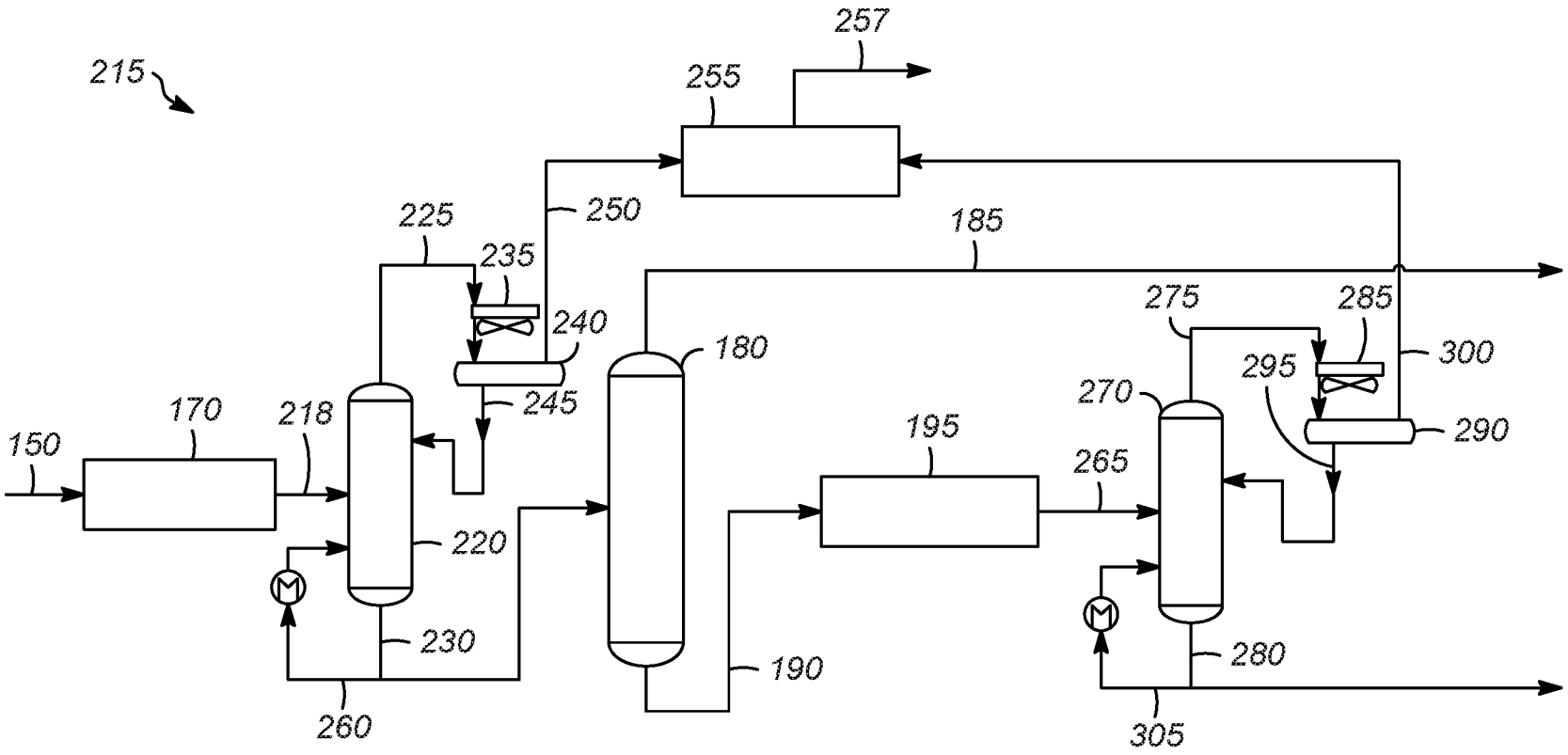
FIG. 2 is an illustration of a portion of the process of FIG. 1.

FIG. 2 shows the isomerization section 215 of one embodiment of the process 100 of FIG. 1 in more detail. The $C_7$ stream 150 is sent to a first $C_7$ isomerization zone 170 as described above. The effluent 218 from the first $C_7$ isomerization zone 170 is sent to a first stabilizer column 220 where it is separated into a first stabilizer overhead stream 225 comprising chloride compounds, hydrogen, and $C_{4-}$ hydrocarbons, and a first stabilizer bottom stream 230 comprising $C_{5+}$ isomerate. The first stabilizer overhead stream 225 can be sent to a condenser 235 to be cooled and then to a receiver 240. The liquid stream 245 from the receiver 240 can be refluxed to the first stabilizer column 220. (The pumps associated with the reflux are not shown.) There can be an optional trim cooler between the condenser 235 and the receiver 240. Typically, the first stabilizer column 220 is designed as a total reflux column without an overhead liquid product. The overhead gas product 250 can be sent to a chloride removal section 255 to remove chloride compounds and produce a gas stream 257. Suitable chloride removal sections include, but are not limited to, chloride scrubbers or recontact systems (e.g., the system described in U.S. Pat. No. 9,573,109). If an overhead liquid product is desired, a portion of the liquid stream 245 can be sent to a separate chloride removal section to remove chloride compounds (not shown).

A portion 260 of the first stabilizer bottom stream 230 can be sent to reboiler and returned to the first stabilizer column 220 as required.

The rest of the first stabilizer bottom stream 230 is sent to the deisoheptanizer 180. The deisoheptanizer bottom stream 190 is sent to the second $C_7$ isomerization zone 195. The effluent 265 from the second $C_7$ isomerization zone 195 is sent to a second stabilizer column 270 where it is separated into a second stabilizer overhead stream 275 comprising chloride compounds, hydrogen, and $C_{4-}$ hydrocarbons, and a second stabilizer bottom stream 280 comprising $C_{5+}$ isomerate liquid product. The second stabilizer overhead stream 275 can be sent to a second condenser 285 to be cooled and then to a second receiver 290. The liquid stream 295 from the second receiver 290 can be refluxed to the second stabilizer column 270. There can be an optional second trim cooler between the second condenser 285 and the second receiver 290, if desired. Typically, the second stabilizer column 270 is designed as a total reflux column without an overhead liquid product. The overhead gas product 300 can be sent to a chloride removal section 255 to remove chloride compounds. If an overhead liquid product is desired, a portion of the liquid stream 295 can be sent to a separate chloride removal section to remove chloride compounds (not shown).

A portion 305 of the second stabilizer bottom stream 280 can be sent to reboiler and returned to the second stabilizer column 270 as required.

As can be seen, this arrangement involves the use of two stabilizer columns, two condensers, two receivers, two reboilers, and optionally two trim coolers (The pumps associated with the reflux are not shown), which significantly increases the capital cost and equipment count of the process.

Figure 3:
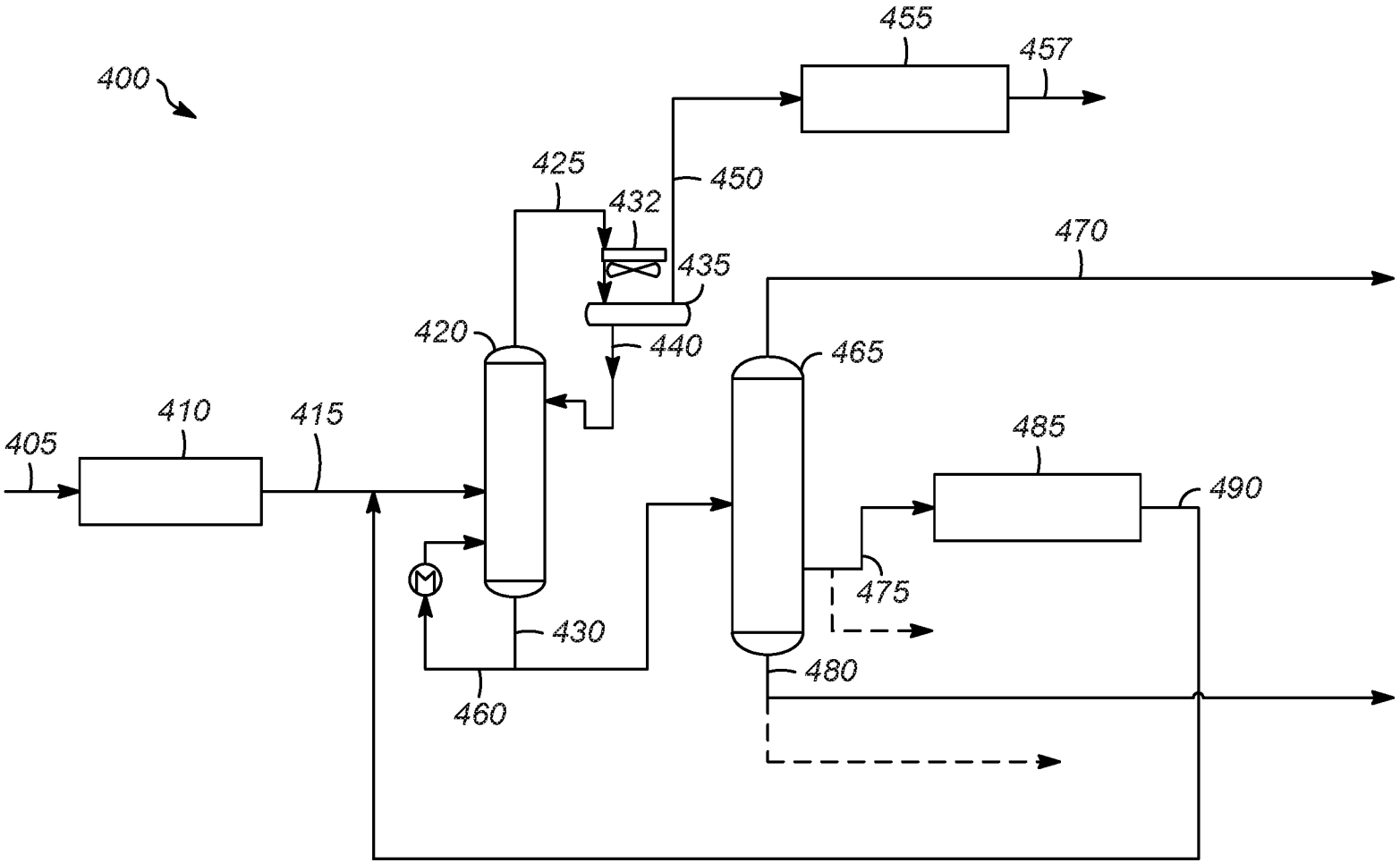
FIG. 3 is an illustration of one embodiment of the process of the present invention.

FIG. 3 illustrates one embodiment of a process 400 utilizing a single stabilizer column. The $C_7$ stream 405 is sent to the first $C_7$ isomerization zone 410. The effluent 415 from the first $C_7$ isomerization zone 410 is sent to the stabilizer column 420 where it is separated into a stabilizer overhead stream 425 comprising chloride compounds, hydrogen, and $C_{4-}$ hydrocarbons, and a stabilizer bottom stream 430 comprising $C_{5+}$ isomerate liquid product. The stabilizer overhead stream 425 can be sent to a condenser 432 to be cooled and then to a receiver 435. The liquid stream 440 from the receiver 435 can be refluxed to the stabilizer column 420. There can be an optional trim cooler between the condenser 432 and the receiver 435, if desired. Typically, the stabilizer column 420 is designed as a total reflux column without an overhead liquid product. The overhead gas product 450 can be sent to a chloride removal section 455 to remove chloride compounds and produce a gas stream 457 to be treated to meet product specifications. If an overhead liquid product is desired, a portion of the liquid stream 440 can be sent to a separate chloride removal section to remove chloride compounds (not shown).

A portion 460 of the stabilizer bottom stream 430 can be sent to reboiler and returned to the stabilizer column 420 as required.

The rest of the stabilizer bottom stream 430 is sent to the deisoheptanizer 465 where it is separated into a deisoheptanizer overhead stream 470 comprising multibranched $C_7$ paraffins, and $C_7$ cycloalkanes with cyclopentane rings, a deisoheptanizer sidecut stream 475 comprising normal $C_7$ paraffins, and $C_7$ cycloalkanes with cyclohexane rings, and a deisoheptanizer bottom stream 480 comprising $C_{8+}$ hydrocarbons. The deisoheptanizer overhead stream 470 is sent for blending as described above. The deisoheptanizer sidecut stream 475 is sent to the second $C_7$ isomerization zone 485. The effluent 490 from the second $C_7$ isomerization zone 485 is recycled to the stabilizer column 420. All or a portion of the deisoheptanizer bottom stream 480 can be sent for blending. Alternatively, all or a portion of the deisoheptanizer bottom stream 480 can be sent to a reformer.

A slip stream from deisoheptanizer sidecut stream 475 or Stabilizer Bottoms stream 430 can be sent to gasoline blending. By adjusting the amount of one or both of these slip stream, the sidecut stream 475 sent to the second $C_7$ isomerization zone 485, the $C_7$ isomerization product RONC can be adjusted to meet the desired 95 RONC gasoline requirement. The highest RONC in $C_7$ isomerate can be obtained by sending the low octane normal $C_7$ paraffins, and $C_7$ cycloalkanes with cyclohexane-rings to the second $C_7$ isomerization zone 485 to convert them to multibranched $C_7$ paraffins, and $C_7$ cycloalkanes with cyclopentane-rings.

By sharing a single stabilizer column, this arrangement reduces the capital cost by eliminating the second stabilizer column, condenser, receiver, reboiler, and optional trim cooler (The pumps associated with the reflux are not shown).

Figure 4:
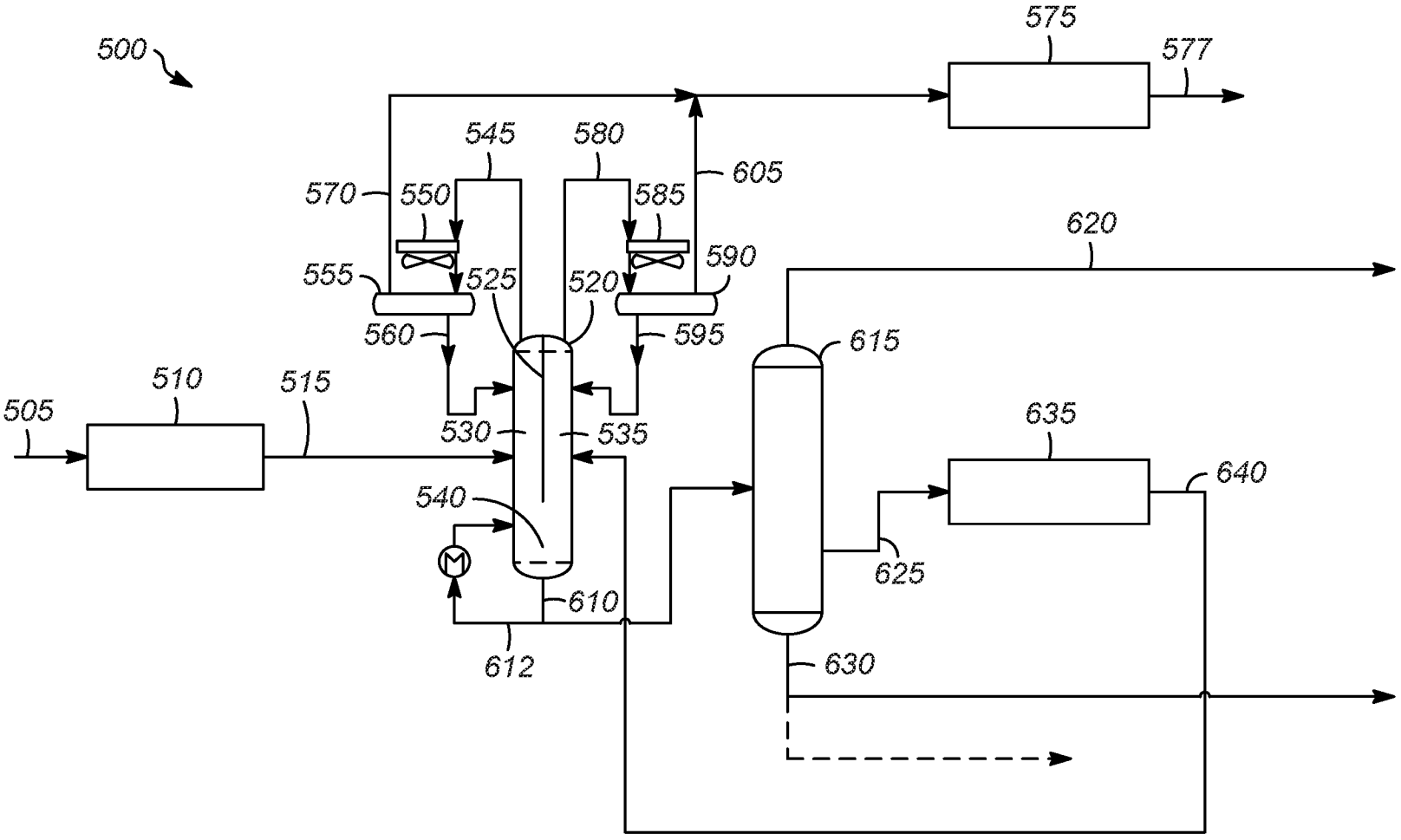
FIG. 4 is an illustration of another embodiment of the process of the present invention.

FIG. 4 shows another embodiment of a process 500 utilizing a single stabilizer column.

The $C_7$ stream 505 is sent to the first $C_7$ isomerization zone 510. The effluent 515 from the first $C_7$ isomerization zone 510 is sent to the stabilizer column 520.

The stabilizer column 520 has a wall 525 extending downward from the top of the stabilizer column 520 and ending above the bottom of the stabilizer column 520. The wall 525 forms first and second sides 530 and 535 with a section 540 below the wall 525. In this arrangement, the effluent 515 from the first $C_7$ isomerization zone 510 is introduced to the first side 530 above the bottom of the wall 525.

The stabilizer overhead stream 545 from the first side 530 can be sent to a condenser 550 to be cooled and then to a receiver 555. The liquid stream 560 from the receiver 555 can be refluxed to the first side 530 of the stabilizer column 520. There can be an optional trim cooler between the condenser 550 and the receiver 555, if desired. Typically, the stabilizer column 520 is designed as a total reflux column without an overhead liquid product. The overhead gas stream 570 can be sent to the chloride removal section 575 to remove chloride compounds and produce a gas stream 577 to be treated to meet product specifications. If an overhead liquid product is desired, a portion of the liquid stream 560 can be sent to a separate chloride removal section to remove chloride compounds (not shown).

The second stabilizer overhead stream 580 from the second side 535 can be sent to a second condenser 585 to be cooled and then to a second receiver 590. The liquid stream 595 from the second receiver 590 can be refluxed to the second side 535 of the stabilizer column 520. There can be an optional second trim cooler between the second condenser 585 and the second receiver 590, if desired. Typically, the stabilizer column 520 is designed as a total reflux column without an overhead liquid product. The overhead gas stream 605 can be sent to the chloride removal section 575 to remove chloride compounds. If an overhead liquid product is desired, a portion of the liquid stream 595 can be sent to a separate chloride removal section to remove chloride compounds (not shown).

A portion 612 of the stabilizer bottom stream 610 can be sent to reboiler and returned to section 540 (below the bottom of wall 525) of the stabilizer column 520 as required.

The rest of the stabilizer bottom stream 610 is sent to the deisoheptanizer 615 where it is separated into a deisoheptanizer overhead stream 620 comprising multi-branched $C_7$ paraffins and $C_7$ cycloalkanes with cyclopentane rings, a deisoheptanizer sidecut stream 625 comprising normal $C_7$ paraffins and $C_7$ cycloalkanes with cyclohexane rings, and a deisoheptanizer bottom stream 630 comprising $C_{8+}$ hydrocarbons. The deisoheptanizer overhead stream 620 is sent for blending.

The deisoheptanizer sidecut stream 625 is sent to the second $C_7$ isomerization zone 635. The effluent 640 from the second $C_7$ isomerization zone 635 is introduced into the second side 535 above the bottom of the wall 525.

All or a portion of the deisoheptanizer bottom stream 630 can be sent for blending. Alternatively, all or a portion of the deisoheptanizer bottom stream 630 can be sent to a reformer.

This arrangement reduces costs due to the sharing of the single stabilizer column and reboiler. In addition, the separate overhead gas streams, overhead gas stream 570 from first $C_7$ isomerization zone 510 and overhead gas stream 605 from second $C_7$ isomerization zone 635, can be analyzed separately in order to control the hydrogen to hydrocarbon molar ration at the reactor outlet for each isomerization zone.

Figure 5:
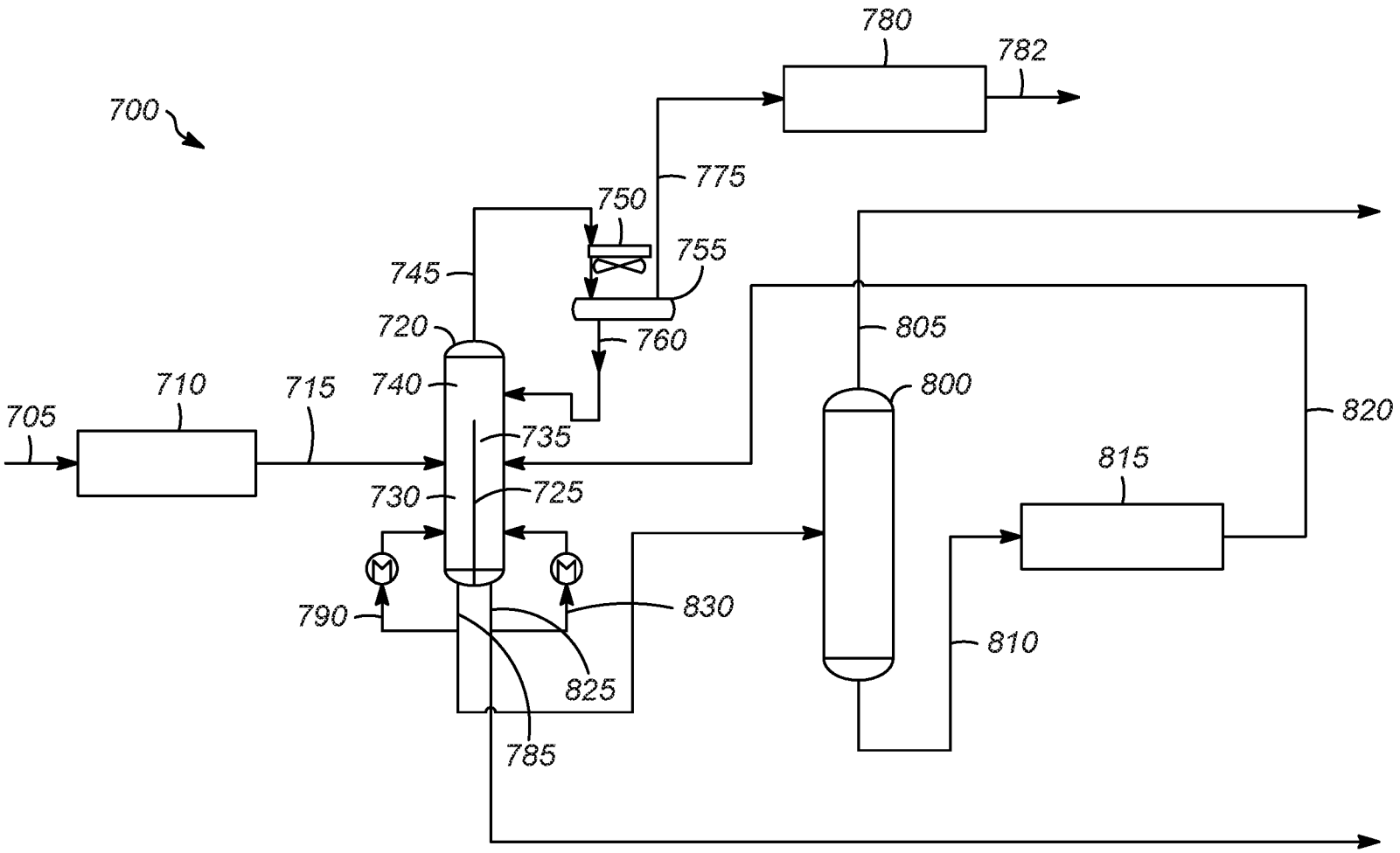
FIG. 5 is an illustration of another embodiment of the process of the present invention.

FIG. 5 shows another embodiment in which a single stabilizer column is utilized.

The $C_7$ stream 705 is sent to the first $C_7$ isomerization zone 710. The effluent 715 from the first $C_7$ isomerization zone 710 is sent to the stabilizer column 720.

The stabilizer column 720 has a wall 725 extending upward from the bottom of the stabilizer column 720 and ending below the top of the stabilizer column 720. The wall 725 forms first and second sides 730 and 735 with a section 740 above the wall 725. In this arrangement, the effluent 715 from the first $C_7$ isomerization zone 710 is introduced to the first side 730 below the top of the wall 725.

The stabilizer overhead stream 745 can be sent to a condenser 750 to be cooled and then to a receiver 755. The liquid stream 760 from the receiver 755 can be refluxed to section 740 (above the top of the wall 725) of the stabilizer column 720. There can be an optional trim cooler between the condenser 750 and the receiver 755, if desired. Typically, the stabilizer column 720 is designed as a total reflux column without an overhead liquid product. The overhead gas product 775 can be sent to the chloride removal section 780 to remove chloride compounds and produce a gas stream 782 to be treated to meet product specifications. If an overhead liquid product is desired, a portion of the liquid stream 760 can be sent to a separate chloride removal section to remove chloride compounds (not shown).

The first stabilizer bottom stream 785 from the first side 730 is sent to the deisoheptanizer 800. A portion 790 of the first stabilizer bottom stream 785 can be sent to reboiler and returned to the first side 730 of the stabilizer column 720.

Optionally, a portion of the first stabilizer bottom stream 785 can be sent to gasoline blending based on the final RONC requirements of the whole complex.

The first stabilizer bottom stream 785 is separated in the deisoheptanizer 800 into a deisoheptanizer overhead stream 805 comprising multi-branched $C_7$ paraffins and $C_7$ cycloalkanes with cyclopentane-rings and a deisoheptanizer bottom stream 810 comprising low octane normal $C_7$ paraffins and $C_7$ cycloalkanes with cyclohexane-rings. The deisoheptanizer overhead stream 805 is sent for blending as described above. The effluent 820 from the second $C_7$ isomerization zone 815 is recycled to the second side 735 (below the top of the wall 725) of the stabilizer column 720.

The second stabilizer bottom stream 825 from the second side 735 is sent for blending as described above. A portion 830 of the second stabilizer bottom stream 825 can be sent to reboiler and returned to the second side 735 of the stabilizer column 720.

This arrangement reduces equipment costs due to the sharing of the stabilizer columns and associated equipment. By utilizing a stabilizer with a wall extending up from the bottom of the column, the first stabilizer bottom stream 785 from the first $C_7$ isomerization zone 710 is kept completely separate from the second stabilizer bottom stream 825 from the second $C_7$ isomerization zone 815. The separate isomerate effluents makes it easier to blend gasoline to obtain multiple gasoline pools with different RONC targets.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

By about, we mean within 10% of the stated value, or 5%, or 1%.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

SPECIFIC EMBODIMENTS

While the following is described in conjunction with specific embodiments, it will be understood that this description is intended to illustrate and not limit the scope of the preceding description and the appended claims.

A first embodiment of the invention is a process for production of gasoline comprising separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the light stream from the naphtha splitter in a $C_5$-$C_6$ isomerization zone at isomerization conditions to form a $C_5$-$C_6$ isomerization effluent; isomerizing the $C_7$ stream from the naphtha splitter in a first $C_7$ isomerization zone at first isomerization conditions favoring the formation of multi-branched $C_7$ paraffins to form a first $C_7$ isomerization effluent; introducing the first $C_7$ isomerization effluent into a single stabilizer column to remove chloride compounds and light ends to form a stabilized $C_7$ isomerization effluent; deisoheptanizing at least a portion of the first stabilized $C_7$ isomerization effluent in a deisoheptanizer into at least a first stream comprising multi-branched $C_7$ paraffins and $C_7$ cyclopentanes and a second stream comprising n-$C_7$ paraffins and $C_7$ cyclohexane hydrocarbons; isomerizing the second stream from the deisoheptanizer in a second $C_7$ isomerization zone at second isomerization conditions favoring the formation of cyclopentanes over cyclohexanes to form a second $C_7$ isomerization effluent; recycling at least a portion of the second $C_7$ isomerization effluent to the stabilizer column; reforming the heavy stream from the naphtha splitter in a reforming zone under reforming conditions forming a reformate effluent; blending one or more of at least a portion of the $C_5$-$C_6$ isomerization effluent, the first stream from the deisoheptanizer, or the reformate effluent to form a gasoline blend. An embodiment of the invention is one, any or all of prior embodiments in this paragraph up through the first embodiment in this paragraph wherein deisoheptanizing at least the portion of the first stabilized $C_7$ isomerization effluent comprises deisoheptanizing all of the first stabilized $C_7$ isomerization effluent. An embodiment of the invention is one, any or all of prior embodiments in this paragraph up through the first embodiment in this paragraph further comprising introducing a gas stream from the overhead stream of the stabilizer column into a chloride removal section to remove the chloride compounds. An embodiment of the invention is one, any or all of prior embodiments in this paragraph up through the first embodiment in this paragraph wherein the stabilizer column has a wall extending downward from a top of the stabilizer column and ending above a bottom of the stabilizer column, wherein the $C_7$ isomerization effluent is introduced into a first side of the stabilizer column above a bottom of the wall, wherein the second $C_7$ isomerization effluent is introduced into a second side of the stabilizer column above the bottom of the wall; and wherein deisoheptanizing at least the portion of the first stabilized $C_7$ isomerization effluent comprises deisoheptanizing all of the first stabilized $C_7$ isomerization effluent. An embodiment of the invention is one, any or all of prior embodiments in this paragraph up through the first embodiment in this paragraph further comprising introducing a gas stream from the first side and a gas stream from the second side into a chloride removal section to remove the chloride compounds. An embodiment of the invention is one, any or all of prior embodiments in this paragraph up through the first embodiment in this paragraph wherein the stabilizer column has a wall extending upward from a bottom of the stabilizer column and ending below a top of the column, wherein the $C_7$ isomerization effluent is introduced into a first side of the stabilizer column below a top of the wall, wherein at least the portion of the second $C_7$ isomerization effluent is introduced to a second side of the stabilizer column below the top of the wall; and wherein deisoheptanizing at least the portion of the first stabilized $C_7$ isomerization effluent comprises deisoheptanizing a bottom stream from the first side of the stabilizer column. An embodiment of the invention is one, any or all of prior embodiments in this paragraph up through the first embodiment in this paragraph further comprising blending a bottom stream from the second side of the stabilizer column with the gasoline blend. An embodiment of the invention is one, any or all of prior embodiments in this paragraph up through the first embodiment in this paragraph further comprising separating an overhead stream from the stabilizer column into a liquid stream and a gas stream; introducing the gas stream into a chloride removal section to remove the chloride compounds. An embodiment of the invention is one, any or all of prior embodiments in this paragraph up through the first embodiment in this paragraph wherein deisoheptanizing at least the portion of the first stabilized $C_7$ isomerization effluent in the deisoheptanizer into at least the first stream and the second stream comprises deisoheptanizing at least the portion of the first stabilized $C_7$ isomerization effluent in the deisoheptanizer into at least the first stream, the second stream, and a third stream comprising $C_{8+}$ heavy hydrocarbons. An embodiment of the invention is one, any or all of prior embodiments in this paragraph up through the first embodiment in this paragraph further comprising at least one of blending the third stream into the gasoline blend; or reforming the third stream. An embodiment of the invention is one, any or all of prior embodiments in this paragraph up through the first embodiment in this paragraph further comprising blending a portion of the second $C_7$ isomerization effluent with the gasoline blend.

A second embodiment of the invention is a process for production of gasoline comprising separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons; isomerizing at least a portion of the light stream from the naphtha splitter in a $C_5$-$C_6$ isomerization zone at isomerization conditions to form a $C_5$-$C_6$ isomerization effluent; isomerizing the $C_7$ stream from the naphtha splitter in a first $C_7$ isomerization zone at first isomerization conditions favoring the formation of multi-branched $C_7$ paraffins to form a first $C_7$ isomerization effluent; introducing the first $C_7$ isomerization effluent into a single stabilizer column to form an overhead stream and a first stabilized $C_7$ isomerization effluent; introducing a gas stream from the overhead stream of the stabilizer column into a chloride removal section to remove the chloride compounds; deisoheptanizing at least a portion of the first stabilized $C_7$ isomerization effluent in a deisoheptanizer into at least a first stream comprising multi-branched $C_7$ paraffins and $C_7$ cyclopentanes and a second stream comprising n-$C_7$ paraffins and $C_7$ cyclohexane hydrocarbons; isomerizing the second stream from the deisoheptanizer in a second $C_7$ isomerization zone at second isomerization conditions favoring the formation of cyclopentanes over cyclohexanes to form a second $C_7$ isomerization effluent; recycling at least a portion of the second $C_7$ isomerization effluent to the stabilizer column; reforming the heavy stream from the naphtha splitter in a reforming zone under reforming conditions forming a reformate effluent; blending one or more of at least a portion of the $C_5$-$C_6$ isomerization effluent, the first stream from the deisoheptanizer, or the reformate effluent to form a gasoline blend. An embodiment of the invention is one, any or all of prior embodiments in this paragraph up through the second embodiment in this paragraph wherein deisoheptanizing at least the portion of the first stabilized $C_7$ isomerization effluent comprises deisoheptanizing all of the first stabilized $C_7$ isomerization effluent. An embodiment of the invention is one, any or all of prior embodiments in this paragraph up through the second embodiment in this paragraph wherein the stabilizer column has a wall extending downward from a top of the stabilizer column and ending above a bottom of the stabilizer column, wherein the $C_7$ isomerization effluent is introduced into a first side of the stabilizer column above a bottom of the wall, wherein the second $C_7$ isomerization effluent is introduced into a second side of the stabilizer column above the bottom of the wall; and wherein deisoheptanizing at least the portion of the first stabilized $C_7$ isomerization effluent comprises deisoheptanizing all of the first stabilized $C_7$ isomerization effluent. An embodiment of the invention is one, any or all of prior embodiments in this paragraph up through the second embodiment in this paragraph further comprising introducing a gas stream from the first side and a gas stream from the second side into a chloride removal section to remove the chloride compounds. An embodiment of the invention is one, any or all of prior embodiments in this paragraph up through the second embodiment in this paragraph wherein the stabilizer column has a wall extending upward from a bottom of the stabilizer column and ending below a top of the column, wherein the $C_7$ isomerization effluent is introduced into a first side of the stabilizer column below a top of the wall, wherein at least the portion of the second $C_7$ isomerization effluent is introduced to a second side of the stabilizer column below the top of the wall; and wherein deisoheptanizing at least the portion of the first stabilized $C_7$ isomerization effluent comprises deisoheptanizing a bottom stream from the first side of the stabilizer column. An embodiment of the invention is one, any or all of prior embodiments in this paragraph up through the second embodiment in this paragraph further comprising blending a bottom stream from the second side of the stabilizer column with the gasoline blend. An embodiment of the invention is one, any or all of prior embodiments in this paragraph up through the second embodiment in this paragraph further comprising separating an overhead stream from the stabilizer column into a liquid stream and a gas stream; introducing the gas stream into a chloride removal section to remove the chloride compounds. An embodiment of the invention is one, any or all of prior embodiments in this paragraph up through the second embodiment in this paragraph wherein deisoheptanizing at least the portion of the first stabilized $C_7$ isomerization effluent in the deisoheptanizer into at least the first stream and the second stream comprises deisoheptanizing at least the portion of the first stabilized $C_7$ isomerization effluent in the deisoheptanizer into at least the first stream, the second stream, and a third stream comprising $C_{8+}$ heavy hydrocarbons. An embodiment of the invention is one, any or all of prior embodiments in this paragraph up through the second embodiment in this paragraph further comprising at least one of blending the third stream into the gasoline blend; or reforming the third stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A process for production of gasoline comprising:

separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons;

isomerizing at least a portion of the light stream from the naphtha splitter in a $C_5$-$C_6$ isomerization zone at isomerization conditions to form a $C_5$-$C_6$ isomerization effluent;

isomerizing the $C_7$ stream from the naphtha splitter in a first $C_7$ isomerization zone at first isomerization conditions favoring the formation of multi-branched $C_7$ paraffins to form a first $C_7$ isomerization effluent;

introducing the first $C_7$ isomerization effluent into a single stabilizer column to remove chloride compounds and light ends to form a stabilized $C_7$ isomerization effluent;

deisoheptanizing at least a portion of the first stabilized $C_7$ isomerization effluent in a deisoheptanizer into at least a first stream comprising multi-branched $C_7$ paraffins and $C_7$ cyclopentanes and a second stream comprising n-$C_7$ paraffins and $C_7$ cyclohexane hydrocarbons;

isomerizing the second stream from the deisoheptanizer in a second $C_7$ isomerization zone at second isomerization conditions favoring the formation of cyclopentanes over cyclohexanes to form a second $C_7$ isomerization effluent;

recycling at least a portion of the second $C_7$ isomerization effluent to the stabilizer column;

reforming the heavy stream from the naphtha splitter in a reforming zone under reforming conditions forming a reformate effluent;

blending one or more of: at least a portion of the $C_5$-$C_6$ isomerization effluent, the first stream from the deisoheptanizer, or the reformate effluent to form a gasoline blend.

2. The process of claim 1 wherein deisoheptanizing at least the portion of the first stabilized $C_7$ isomerization effluent comprises deisoheptanizing all of the first stabilized $C_7$ isomerization effluent.

3. The process of claim 1 further comprising:

introducing a gas stream from an overhead stream of the stabilizer column into a chloride removal section to remove the chloride compounds.

4. The process of claim 1 wherein the stabilizer column has a wall extending downward from a top of the stabilizer column and ending above a bottom of the stabilizer column, wherein the $C_7$ isomerization effluent is introduced into a first side of the stabilizer column above a bottom of the wall, wherein the second $C_7$ isomerization effluent is introduced into a second side of the stabilizer column above the bottom of the wall; and wherein deisoheptanizing at least the portion of the first stabilized $C_7$ isomerization effluent comprises deisoheptanizing all of the first stabilized $C_7$ isomerization effluent.

5. The process of claim 4 further comprising:

introducing a gas stream from the first side and a gas stream from the second side into a chloride removal section to remove the chloride compounds.

6. The process of claim 1 wherein the stabilizer column has a wall extending upward from a bottom of the stabilizer column and ending below a top of the column, wherein the $C_7$ isomerization effluent is introduced into a first side of the stabilizer column below a top of the wall, wherein at least the portion of the second $C_7$ isomerization effluent is introduced to a second side of the stabilizer column below the top of the wall; and wherein deisoheptanizing at least the portion of the first stabilized $C_7$ isomerization effluent comprises deisoheptanizing a bottom stream from the first side of the stabilizer column.

7. The process of claim 6 further comprising:

blending a bottom stream from the second side of the stabilizer column with the gasoline blend.

8. The process of claim 6 further comprising:

separating an overhead stream from the stabilizer column into a liquid stream and a gas stream;

introducing the gas stream into a chloride removal section to remove the chloride compounds.

9. The process of claim 1 wherein deisoheptanizing at least the portion of the first stabilized $C_7$ isomerization effluent in the deisoheptanizer into at least the first stream and the second stream comprises deisoheptanizing at least the portion of the first stabilized $C_7$ isomerization effluent in the deisoheptanizer into at least the first stream, the second stream, and a third stream comprising $C_{8+}$ heavy hydrocarbons.

10. The process of claim 9 further comprising at least one of:

blending the third stream into the gasoline blend; or reforming the third stream.

11. The process of claim 1 further comprising:

blending a portion of the second $C_7$ isomerization stabilizer effluent with the gasoline blend.

12. A process for production of gasoline comprising:

separating a naphtha feed in a naphtha splitter into a light stream comprising $C_6$ and lighter boiling hydrocarbons, a $C_7$ stream comprising $C_7$ hydrocarbons, and a heavy stream comprising $C_8$ and heavier hydrocarbons;

isomerizing at least a portion of the light stream from the naphtha splitter in a $C_5$-$C_6$ isomerization zone at isomerization conditions to form a $C_5$-$C_6$ isomerization effluent;

isomerizing the $C_7$ stream from the naphtha splitter in a first $C_7$ isomerization zone at first isomerization conditions favoring the formation of multi-branched $C_7$ paraffins to form a first $C_7$ isomerization effluent;

introducing the first $C_7$ isomerization effluent into a single stabilizer column to form an overhead stream and a first stabilized $C_7$ isomerization effluent;

introducing a gas stream from the overhead stream of the stabilizer column into a chloride removal section to remove the chloride compounds;

deisoheptanizing at least a portion of the first stabilized $C_7$ isomerization effluent in a deisoheptanizer into at least a first stream comprising multi-branched $C_7$ paraffins and $C_7$ cyclopentanes and a second stream comprising n-$C_7$ paraffins and $C_7$ cyclohexane hydrocarbons;

isomerizing the second stream from the deisoheptanizer in a second $C_7$ isomerization zone at second isomerization conditions favoring the formation of cyclopentanes over cyclohexanes to form a second $C_7$ isomerization effluent;

recycling at least a portion of the second $C_7$ isomerization effluent to the stabilizer column;

reforming the heavy stream from the naphtha splitter in a reforming zone under reforming conditions forming a reformate effluent;

blending one or more of: at least a portion of the $C_5$-$C_6$ isomerization effluent, the first stream from the deisoheptanizer, or the reformate effluent to form a gasoline blend.

13. The process of claim 12 wherein deisoheptanizing at least the portion of the first stabilized $C_7$ isomerization effluent comprises deisoheptanizing all of the first stabilized $C_7$ isomerization effluent.

14. The process of claim 12 wherein the stabilizer column has a wall extending downward from a top of the stabilizer column and ending above a bottom of the stabilizer column, wherein the $C_7$ isomerization effluent is introduced into a first side of the stabilizer column above a bottom of the wall, wherein the second $C_7$ isomerization effluent is introduced into a second side of the stabilizer column above the bottom of the wall; and wherein deisoheptanizing at least the portion of the first stabilized $C_7$ isomerization effluent comprises deisoheptanizing all of the first stabilized $C_7$ isomerization effluent.

15. The process of claim 14 further comprising:

introducing a gas stream from the first side and a gas stream from the second side into a chloride removal section to remove the chloride compounds.

16. The process of claim 12 wherein the stabilizer column has a wall extending upward from a bottom of the stabilizer column and ending below a top of the column, wherein the $C_7$ isomerization effluent is introduced into a first side of the stabilizer column below a top of the wall, wherein at least the portion of the second $C_7$ isomerization effluent is introduced to a second side of the stabilizer column below the top of the wall; and wherein deisoheptanizing at least the portion of the first stabilized $C_7$ isomerization effluent comprises deisoheptanizing a bottom stream from the first side of the stabilizer column.

17. The process of claim 16 further comprising:

blending a bottom stream from the second side of the stabilizer column with the gasoline blend.

18. The process of claim 16 further comprising:

separating an overhead stream from the stabilizer column into a liquid stream and a gas stream;

introducing the gas stream into a chloride removal section to remove the chloride compounds.

19. The process of claim 1 wherein deisoheptanizing at least the portion of the first stabilized $C_7$ isomerization effluent in the deisoheptanizer into at least the first stream and the second stream comprises deisoheptanizing at least the portion of the first stabilized $C_7$ isomerization effluent in the deisoheptanizer into at least the first stream, the second stream, and a third stream comprising $C_{8+}$ heavy hydrocarbons.

20. The process of claim 19 further comprising at least one of:

blending the third stream into the gasoline blend; or reforming the third stream.

* * * * *